US005152850A

United States Patent [19]

Takahashi et al.

[11] Patent Number: 5,152,850

[45] Date of Patent: Oct. 6, 1992

[54] HEAT-RESISTANT, FERRITIC CAST STEEL AND EXHAUST EQUIPMENT MEMBER MADE THEREOF

[75] Inventors: Norio Takahashi, Oomiya; Toshio Fujita, Tokyo, both of Japan

[73] Assignee: Hitachi Metals, Ltd., Tokyo, Japan

[21] Appl. No.: 674,949

[22] Filed: Mar. 26, 1991

[30] Foreign Application Priority Data

| | | | |
|---|---|---|---|
| Mar. 27, 1990 | [JP] | Japan | 2-77759 |
| Aug. 2, 1990 | [JP] | Japan | 2-205462 |
| Mar. 20, 1991 | [JP] | Japan | 3-081647 |

[51] Int. Cl.[5] ..... C22C 38/22; C22C 38/24

[52] U.S. Cl. ..... 148/325; 420/69

[58] Field of Search ..... 148/325; 420/69

[56] References Cited

U.S. PATENT DOCUMENTS

| | | | |
|---|---|---|---|
| 2,880,085 | 3/1892 | Kirkby et al. | 148/325 |
| 3,700,432 | 10/1972 | *Brickner | 420/69 |
| 4,799,972 | 1/1989 | Masuyama et al. | 148/325 |

FOREIGN PATENT DOCUMENTS

| | | | |
|---|---|---|---|
| 212628 | 7/1956 | Australia . | |
| 46-18845 | 5/1971 | Japan | 420/69 |
| 369481 | 5/1963 | Switzerland . | |
| 337404 | 10/1930 | United Kingdom . | |
| 1205250 | 9/1970 | United Kingdom . | |

*Primary Examiner*—Deborah Yee

*Attorney, Agent, or Firm*—Finnegan, Henderson, Farabow, Garrett & Dunner

[57] ABSTRACT

The heat-resistant, ferritic cast steel has a composition consisting essentially, by weight, of C: 0.05–0.45%, Si: 0.4–2.0%, Mn: 0.3–1.0%, Cr: 16.0–25.0%, W: 1.0–5.0%, Nb and/or V: 0.01–1.0% (each 0.5% or less), and Fe and inevitable impurities: balance, the cast steel having, in addition to a usual $\alpha$-phase, an $\alpha'$-phase transformed from a $\gamma$-phase and composed of an $\alpha$-phase and carbides, an area ratio $(\alpha'/(\alpha+\alpha')$ being 20–90%. The cast steel is subjected to an annealing treatment at a temperature lower than a $(\gamma+\alpha)$ phase region. The heat-resistant, ferritic cast steel is suitable for exhaust equipment members such as exhaust manifolds, turbine housings, etc.

7 Claims, 2 Drawing Sheets

HEAT-RESISTANT, FERRITIC CAST STEEL AND EXHAUST EQUIPMENT MEMBER MADE THEREOF

BACKGROUND OF THE INVENTION

The present invention relates to a heat-resistant cast steel suitable for exhaust equipment members, etc. for automobile engines, and more particularly to a heat-resistant cast steel having excellent thermal fatigue resistance, oxidation resistance, durability, castability and machinability, which can be produced at a low cost, and an exhaust equipment member made of such a heat-resistant cast steel.

Conventional heat-resistant cast iron and heat-resistant cast steel have compositions shown in Table 1 as Comparative Examples. In exhaust equipment members such as exhaust manifolds, turbine housings, etc. for automobiles, heat-resistant cast iron such as high-Si spheroidal graphite cast iron, NI-RESIST cast iron (Ni—Cr—Cu austenite cast iron), etc. shown in Table 1, and exceptionally expensive heat-resistant, high-alloy cast steel such as austenite cast steel, etc. are employed because their operating conditions are extremely severe at high temperatures.

Among these conventional heat-resistant cast iron and heat-resistant cast steel, for instance, high-Si spheroidal graphite cast iron and NI-RESIST cast iron are relatively good in castability, but they are poor in durability such as a thermal fatigue resistance and an oxidation resistance. Accordingly, they cannot be used for members which may be subjected to such a high temperature as 900° C. or higher. Also, heat-resistant, high-alloy cast steel such as heat-resistant austenite cast steel, etc. is excellent in a high-temperature strength at 900° C. or higher, but it is poor in a thermal fatigue life due to a large thermal expansion coefficient. Further, because of poor castability, it is likely to suffer from casting defects such as shrinkage cavities and poor fluidity in the process of casting. In addition, because of poor machinability, the production of parts from these materials is not efficient. Incidentally, besides the above cast iron and cast steel, there is ferritic cast stainless steel, but usual ferritic cast stainless steel shows poor ductility at a room temperature when its high-temperature durability is improved. Accordingly, it cannot be used for members which are subjected to mechanical impact, etc.

OBJECT AND SUMMARY OF THE INVENTION

Accordingly, an object of the present invention is to provide a heat-resistant, ferritic cast steel having excellent durability such as a thermal fatigue resistance and an oxidation resistance, castability, machinability, etc., which can be produced at a low cost, thereby solving the above problems inherent in the conventional heat-resistant cast iron an heat-resistant cast steel.

Another object of the present invention is to provide an exhaust equipment member made of such heat-resistant cast steel.

As a result of intense research in view of the above objects, the inventors have found that by adding proper amounts of W, Nb and/or V and further Ni, B, REM, etc. to the ferritic cast steel, the ferrite matrix and the crystal grain boundaries can be strengthened and the transformation temperature can be elevated without deteriorating the ductility at a room temperature, whereby the high-temperature strength of the cast steel can be improved. The present invention has been completed based upon this finding.

Thus, the heat-resistant, ferritic cast steel according to the present invention has a composition consisting essentially, by weight, of:

C: 0.05–0.45%,
Si: 0.4–2.0%,
Mn: 0.3–1.0%,
Cr: 16.0–25.0%,
W: 1.0–5.0%,
Nb and/or V: 0.01–1.0% (each 0.5% or less), and
Fe and inevitable impurities: balance, said cast steel having, in addition to a usual $\alpha$-phase, a phase (hereinafter referred to as "$\alpha'$-phase") transformed from a $\gamma$-phase and composed of an $\alpha$-phase and carbides, an area ratio ($\alpha'/(\alpha+\alpha')$) being 20–90%, said cast steel being subjected to an annealing treatment at a temperature lower than a ($\gamma+\alpha$) phase region.

Specifically, the heat-resistant, ferritic cast steel according to a first embodiment of the present invention has a composition consisting essentially, by weight, of:

C: 0.10–0.30%,
Si: 0.4–2.0%,
Mn: 0.3–1.0%,
Cr: 16.0–25.0%,
W: 1.0–5.0%,
Nb: 0.01–0.5%,
Ni: 0.1–2.0%,
N: 0.01–0.15%, and
Fe and inevitable impurities: balance, said cast steel having, in addition to a usual $\alpha$-phase, a phase (hereinafter referred to as "$\alpha'$-phase") transformed from a $\gamma$-phase and composed of an $\alpha$-phase and carbides, an area ratio ($\alpha'/(\alpha+\alpha')$) being 20–90%, said cast steel being subjected to an annealing treatment at a temperature lower than a ($\gamma+\alpha$) phase region.

In the above heat-resistant, ferritic cast steel according to the first embodiment, the transformation temperature from the $\alpha$-phase to the $\gamma$-phase is 900° C. or higher.

The heat-resistant, ferritic cast steel according to a second embodiment of the present invention has a composition consisting essentially, by weight, of:

C: 0.05–0.30%,
Si: 0.4–2.0%,
Mn: 0.3–1.0%,
Cr: 16.0–25.0%,
W: 1.0–5.0%,
Nb: 0.01–0.5%,
V: 0.01–0.5%,
B: 0.001–0.01%,
Ni: 0.05–2.0%, and
Fe and inevitable impurities: balance, said cast steel having, in addition to a usual $\alpha$-phase, a phase (hereinafter referred to as "$\alpha'$-phase") transformed from a $\gamma$-phase and composed of an $\alpha$-phase and carbides, an area ratio ($\alpha'/(\alpha+\alpha')$) being 20–70%, said cast steel being subjected to an annealing treatment at a temperature lower than a ($\gamma+\alpha$) phase region.

In the above heat-resistant, ferritic cast steel according to the second embodiment, the transformation temperature from the $\alpha$-phase to the $\gamma$-phase is 950° C. or higher.

The heat-resistant, ferritic cast steel according to a third embodiment of the present invention has a composition consisting essentially, by weight, of:

C: 0.15–0.45%,

Si: 0.4–2.0%,
Mn: 0.3–1.0%,
Cr: 17.0–22.0%,
W: 1.0–4.0%,
Nb and/or V: 0.01–0.5%,
Fe and inevitable impurities: balance,
said cast steel having, in addition to a usual $\alpha$-phase, a phase (hereinafter referred to as "$\alpha'$-phase") transformed from a $\gamma$-phase and composed of an $\alpha$-phase and carbides, an area ratio ($\alpha'/(\alpha+\alpha')$) being 20–80%, said cast steel being subjected to an annealing treatment at a temperature lower than a ($\gamma+\alpha$) phase region.

In the above heat-resistant, ferritic cast steel according to the third embodiment, the transformation temperature from the $\alpha$-phase to the $\gamma$-phase is 1000° C. or higher.

The heat-resistant, ferritic cast steel according to a fourth embodiment of the present invention has a composition consisting essentially, by weight, of:
C: 0.15–0.45%,
Si: 0.4–2.0%,
Mn: 0.3–1.0%,
Cr: 17.0–22.0%,
W: 1.0–4.0%,
Nb and/or V: 0.01–0.5%,
B: 0.001–0.05%,
REM: 0.001–0.05%, and
Fe and inevitable impurities: balance,
said cast steel having, in addition to a usual $\alpha$-phase, a phase (hereinafter referred to as "$\alpha'$-phase") transformed from a $\gamma$-phase and composed of an $\alpha$-phase and carbides, an area ratio ($\alpha'/(\alpha+\alpha')$) being 20–80%, said cast steel being subjected to an annealing treatment at a temperature lower than a ($\gamma+\alpha$) phase region.

In the above heat-resistant, ferritic cast steel according to the fourth embodiment, the transformation temperature from the $\alpha$-phase to the $\gamma$-phase is 1000° C. or higher.

The heat-resistant, ferritic cast steel according to a fifth embodiment of the present invention has a composition consisting essentially, by weight, of:
C: 0.15–0.45%,
Si: 0.4–2.0%,
Mn: 0.3–1.0%,
Cr: 17.0–22.0%,
W: 1.0–4.0%,
Nb and/or V: 0.01–0.5%,
Ni: 0.1–2.0%,
B: 0.001–0.05%,
REM: 0.001–0.05%, and
Fe and inevitable impurities: balance,
said cast steel having, in addition to a usual $\alpha$-phase, a phase (hereinafter referred to as "$\alpha'$-phase") transformed from a $\gamma$-phase and composed of an $\alpha$-phase and carbides, an area ratio ($\alpha'/(\alpha+\alpha')$) being 20–80%, said cast steel being subjected to an annealing treatment at a temperature lower than a ($\gamma+\alpha$) phase region.

In the above heat-resistant, ferritic cast steel according to the fifth embodiment, the transformation temperature from the $\alpha$-phase to the $\gamma$-phase is 1000° C. or higher.

DETAILED DESCRIPTION OF THE INVENTION

Figure 1:
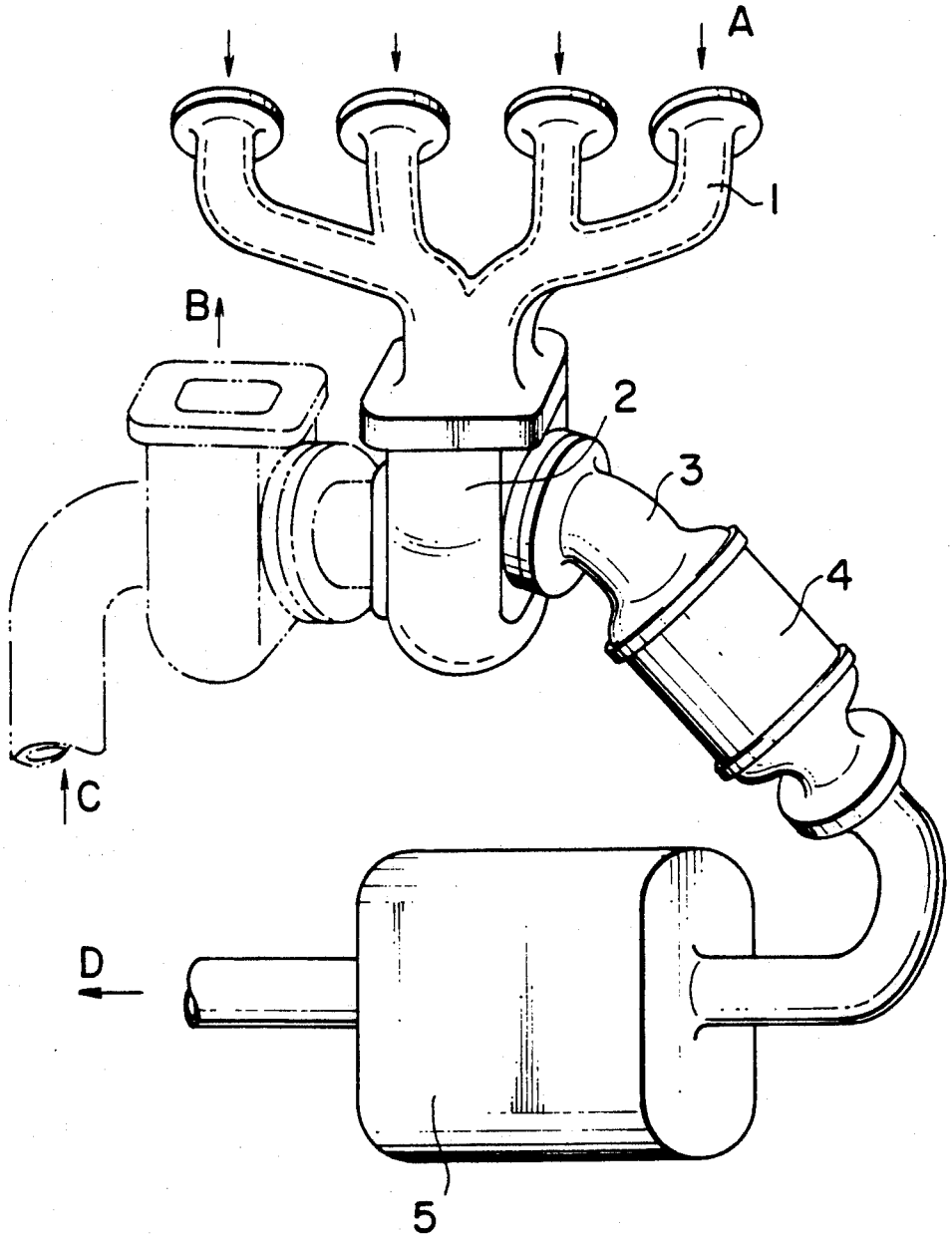
FIG. 1 is a schematic view showing exhaust equipment member (an exhaust manifold and a turbine housing) produced by the heat-resistant, ferritic cast steel of the present invention.

The present invention will be explained in detail below.

By adding to the heat-resistant, ferritic cast steel 1.0–5.0% of W, 0.01–1.0% of Nb and/or V by weight and, if necessary, proper amounts of B, REM, Ni, N alone or in combination, the resulting metal structure contains an $\alpha'$-phase, whereby the heat-resistant, ferritic cast steel shows higher thermal fatigue resistance and oxidation resistance than those of the conventional heat-resistant, high-alloy cast steel, and castability and machinability equivalent to those of the heat-resistant cast iron, without deteriorating its ductility at a room temperature. Further, since the transformation temperature of the heat-resistant, ferritic cast steel is elevated to 900° C. or higher, its thermal fatigue resistance is greatly improved.

The reasons for restricting the composition range of each alloy element in the heat-resistant, ferritic cast steel of the present invention will be explained below.

In the heat-resistant, ferritic cast steel of the present invention, C, Si, Mn, Cr, W, Nb and/or V are indispensable elements.

(1) C (carbon): 0.05–0.45%

C has a function of improving the fluidity and castability of a melt and forming a proper amount of an $\alpha'$-phase. It further has a function of providing the heat-resistant, ferritic cast steel with a high strength at a high temperature of 900° C. or higher. To exhibit such functions effectively, the amount of C should be 0.05% or more. Incidentally, in a general heat-resistant, ferritic cast steel, there is only an $\alpha$-phase at a room temperature, but by adjusting the amount of carbon, a $\gamma$-phase in which C is dissolved is formed at a high temperature, in addition to the $\alpha$-phase existing from a high temperature to a room temperature. This $\gamma$-phase is transformed to ($\alpha$-phase+carbides) by precipitating carbides during the cooling process. The resulting phase ($\alpha$-phase+carbides) is called "$\alpha'$-phase."

On the other hand, when the amount of C exceeds 0.45%, the $\alpha'$-phase is less likely to exist, thereby forming a martensite structure. Also, Cr carbides which decrease the oxidation resistance, corrosion resistance and machinability of the heat-resistant, ferritic cast steel are remarkably precipitated. Accordingly, the amount of C is 0.05–0.45%.

(2) Si (silicon): 0.4–2.0%

Si has effects of narrowing the range of the $\gamma$-phase in the Fe-Cr alloy of the present invention, thereby increasing the stability of its metal structure and its oxidation resistance. Further, it has a function as a deoxidizer and also is effective for improving castability and reducing pin holes in the resulting cast products. To effectively exhibit these effects, the amount of Si should be 0.4% or more. However, when it is excessive, primary carbides grow coarser by a balance with C (carbon equivalent), thereby deteriorating the machinability of the cast steel, and the amount of Si in the ferrite matrix becomes excessive, causing the decrease of the ductility and the formation of a δ-phase at a high temperature. Accordingly, the amount of Si should be 2.0% or less.

(3) Mn (manganese): 0.3–1.0%

Mn is effective like Si as a deoxidizer for the melt, and has a function of improving the fluidity during the casting operation. To exhibit such function effectively, the amount of Mn is 0.3–1.0%.

(4) Cr (chromium): 16.0–25.0%

Cr is an element capable of improving the oxidation resistance and stabilizing the ferrite structure of the heat-resistant, ferritic cast steel. To insure such effects, the amount of Cr should be 16.0% or more. On the other hand, if it is added excessively, coarse primary carbides of Cr are formed, and the formation of the δ-phase is accelerated at a high temperature, resulting in extreme brittleness. Accordingly, the upper limit of Cr should be 25.0%.

(5) W (tungsten): 1.0–5.0%

W has a function of improving the high-temperature strength by strengthening the ferrite matrix without deteriorating the ductility at a room temperature. Accordingly, for the purpose of improving a creep resistance and a thermal fatigue resistance due to the elevation of the transformation temperature, the amount of W should be 1.0% or more. However, when the amount of W exceeds 5.0%, coarse eutectic carbides are formed, resulting in the deterioration of the ductility and machinability. Thus, the amount of W is 5.0% or less.

Incidentally, substantially the same effects can be obtained by the addition of Mo (since Mo has an atomic weight twice as high as that of W, the amount of Mo is ½ that of W by weight). However, since W is stabler than Mo at a high temperature, W is used in the present invetion.

(6) Nb (neobium) and/or V (vanadium): 0.01–1.0%

Nb and V form fine carbides when combined with C, increasing the tensile strength at a high temperature and the thermal fatigue resistance. Also, by suppressing the formation of the Cr carbides, they function to improve the oxidation resistance and machinability of the heat-resistant, ferritic cast steel. For such purposes, the amount of Nb and/or V should be 0.01% or more. However, if they are excessively added, carbides are formed in the crystal grain boundaries, and too much C is consumed by forming the carbides of Nb and V, making it less likely to form the α'-phase. This leads to extreme decrease in strength and ductility. Accordingly, each of Nb or V should be 0.50% or less (1.0% or less in totality).

Incidentally, since carbide-forming temperature ranges are different between Nb and V, precipitation hardening can be expected in a wide temperature range. Accordingly, one or both of Nb and V can be added to obtain large effects.

In the preferred embodiments, Ni, B, REM (rare earth elements) and N may be added alone or in combination together with the above indispensable elements.

Particularly, in the heat-resistant, ferritic cast steel according to the first embodiment, the proportions of the above indispensable elements are as follows:

C: 0.10–0.30%,
Si: 0.4–2.0%,
Mn: 0.3–1.0%,
Cr: 16.0–25.0%,
W: 1.0–5.0%,
Nb: 0.01–0.5%, and N and Ni are contained. The reasons for restricting the amounts of N and Ni are as follows:

(7) N (nitrogen): 0.01–0.15%

N is an element capable of improving the high-temperature strength and the thermal fatigue resistance like C, and such effects can be obtained when the amount of N is 0.01% or more. On the other hand, to insure the production stability and to avoid the brittleness due to the precipitation of Cr nitrides, the amount of N should be 0.15% or less.

(8) Ni (nickel): 0.1–2.0%

Ni is a γ-phase-forming element like C, and to form a proper amount of α'-phase, 0.1% or more of Ni is desirably added. When it exceeds 2.0%, the α-phase having an excellent oxidation resistance decreases, and the α'-phase becomes a martensite phase, leading to the remarkable deterioration of ductility. Accordingly, the amount of Ni should be 2.0% or less.

In the heat-resistant, ferritic cast steel according to the second embodiment, the proportions of the above indispensable elements are as follows:

C: 0.05–0.30%,
Si: 0.4–2.0%,
Mn: 0.3–1.0%,
Cr: 16.0–25.0%,
W: 1.0–5.0%,
Nb: 0.01–0.5%,
V: 0.01–0.5%, and Ni and B are contained. In this embodiment, the amount of Ni is 0.05–2.0%. Also, the reasons for restricting the amount of B are as follows:

(9) B (boron): 0.001–0.01%

B has a function of strengthening the crystal grain boundaries of the cast steel and making carbides in the grain boundaries finer and further deterring the agglomeration and growth of such carbides, thereby improving the high-temperature strength and toughness of the heat-resistant, ferritic cast steel. Accordingly, the amount of B is desirably 0.001% or more. However, if it is excessively added, borides are precipitated, leading to poor high-temperature strength and toughness. Thus, the upper limit of B is 0.01%. Therefore, the amount of B is 0.001–0.01%.

In the heat-resistant, ferritic cast steel according to the third embodiment, the proportions of the above indispensable elements are as follows:

C: 0.15–0.45%,
Si: 0.4–2.0%,
Mn: 0.3–1.0%,
Cr: 17.0–22.0%,
W: 1.0–4.0%,
Nb and/or V: 0.01–0.5%, No other elements are needed.

In the heat-resistant, ferritic cast steel according to the fourth embodiment, the proportions of the above indispensable elements are as follows:

C: 0.15–0.45%,
Si: 0.4–2.0%,
Mn: 0.3–1.0%,
Cr: 17.0–22.0%,
W: 1.0–4.0%,
Nb and/or V: 0.01–0.5%, and B and REM are contained. In this embodiment, the amount of B is 0.001–0.05%. Also, the reasons for restricting the amount of REM are as follows:

(10) REM (rare earth element): 0.001–0.05%

REM is a light rare earth element such as Ce (cerium), La (lanthanum), etc., which is capable of forming stable oxides, thereby improving the oxidation resistance. It also has a function of making the crystal grain boundaries finer. To exhibit such functions effectively, the amount of REM is desirably 0.001% or more. On the other hand, when it is added excessively, it forms non-metallic inclusions which is detrimental to the ductility. Accordingly, the upper limit of REM is 0.05%.

In the heat-resistant, ferritic cast steel according to the fifth embodiment, the proportions of the above indispensable elements are as follows:

C: 0.15–0.45%,
Si: 0.4–2.0%,
Mn: 0.3–1.0%,
Cr: 17.0–22.0%,
W: 1.0–4.0%,
Nb and/or V: 0.01–0.5%, and Ni, B and REM are contained. In this embodiment, the amount of Ni is 0.1–2.0%, the amount of B is 0.001–0.05%, and the amount of REM is 0.001–0.05%.

In sum, the heat-resistant, ferritic cast steel in each embodiment has the following composition:

(1) First embodiment:
C: 0.10–0.30%.
Si: 0.4–2.0%.
Mn: 0.3–1.0%.
Cr: 16.0–25.0%.
W: 1.0–5.0%.
Nb: 0.01–0.5%.
Ni: 0.1–2.0%.
N: 0.01–0.15%.

Preferred composition range:
C: 0.15–0.25%.
Si: 0.7–1.5%.
Mn: 0.4–0.7%.
Cr: 17–22%.
W: 1.2–3%.
Nb: 0.02–0.1%.
Ni: 0.3–1.5%.
N: 0.02–0.08%.

(2) Second embodiment:
C: 0.05–0.30%.
Si: 0.4–2.0%.
Mn: 0.3–1.0%.
Cr: 16.0–25.0%.
W: 1.0–5.0%.
Nb: 0.01–0.5%.
V: 0.01–0.5%.
Ni: 0.05–2.0%.
B: 0.001–0.01%.

Preferred composition range:
C: 0.08–0.20%.
Si: 0.7–1.5%.
Mn: 0.4–0.7%.
Cr: 17–22%.
W: 1.2–3%.
Nb: 0.02–0.1%.
V: 0.05–0.4%.
Ni: 0.3–1.5%.
B: 0.002–0.008%.

(3) Third embodiment:
C: 0.15–0.45%.
Si: 0.4–2.0%.
Mn: 0.3–1.0%.
Cr: 17.0–22.0%.
W: 1.0–4.0%.
Nb and/or V: 0.01–0.5%.

Preferred composition range:
C: 0.20–0.40%.
Si: 0.7–1.5%.
Mn: 0.4–0.7%.
Cr: 18–21%.
W: 1.2–3.0%.
Nb and/or V: 0.02–0.4%.

(4) Fourth embodiment:
C: 0.15–0.45%.
Si: 0.4–2.0%.
Mn: 0.3–1.0%.
Cr: 17.0–22.0%.
W: 1.0–4.0%.
Nb and/or V: 0.01–0.5%.
B: 0.001–0.05%.
REM: 0.001–0.05%.

Preferred composition range:
C: 0.20–0.40%.
Si: 0.7–1.5%.
Mn: 0.4–0.7%.
Cr: 18–21%.
W: 1.2–3.0%.
Nb and/or V: 0.02–0.4%.
B: 0.002–0.03%.
REM: 0.005–0.04%.

(5) Fifth embodiment:
C: 0.15–0.45%.
Si: 0.4–2.0%.
Mn: 0.3–1.0%.
Cr: 17.0–22.0%.
W: 1.0–4.0%.
Nb and/or V: 0.01–0.5%.
Ni: 0.1–2.0%.
B: 0.001–0.05%.
REM: 0.001–0.05%.

Preferred composition range:
C: 0.20–0.40%.
Si: 0.7–1.5%.
Mn: 0.4–0.7%.
Cr: 18–21%.
W: 1.2–3.0%.
Nb and/or V: 0.02–0.4%.
Ni: 0.3–1.5%.
B: 0.002–0.008%.
REM: 0.005–0.04%.

The heat-resistant, ferritic cast steel of the present invention having the above composition has the $\alpha'$-phase transformed from the $\gamma$-phase and composed of the $\alpha$-phase and carbides, in addition to the usual $\alpha$-phase. Incidentally, the "usual $\alpha$-phase" means a $\delta$ (delta) ferrite phase. The precipitated carbides are carbides ($M_{23}C_6$, $M_7C_3$, MC, etc.) of Fe, Cr, W, Nb, etc.

When an area ratio ($\alpha'/(\alpha+\alpha')$) of this $\alpha'$-phase is lower than 20%, the heat-resistant, ferritic cast steel shows poor ductility at a room temperature, so that the cast steel is extremely brittle. On the other hand, when the area ratio ($\alpha'/(\alpha+\alpha')$) exceeds 90%, the cast steel becomes too hard, resulting in poor ductility at a room temperature and extremely poor machinability. Accordingly, the area ratio ($\alpha'/(\alpha+\alpha')$) is 20–90%.

The heat-resistant, ferritic cast steel is subjected to an annealing treatment at a temperature lower than a ($\gamma+\alpha$) phase region. The annealing treatment temperature is generally 700°–850° C., and the annealing time is 1–10 hours. The above annealing temperature is in the range where the $\alpha'$-phase is not transformed to the $\gamma$-phase.

When there is a transformation temperature from the $\alpha$-phase to the $\gamma$-phase in the temperature range in which the heat-resistant, ferritic cast steel is used, a large thermal stress is generated by a heating-cooling cycle, resulting in a short thermal fatigue life. Accordingly, the heat-resistant, ferritic cast steel should have a transformation temperature of 900° C. or higher. To have such a high transformation temperature, it is necessary that the ferrite-forming elements such as Cr, Si, W, V, Nb and the austenite-forming elements such as C, Ni, Co, N, Mn are well balanced.

Incidentally, in the heat-resistant, ferritic cast steel of each embodiment, the area ratio ($\alpha'/(a+\alpha')$) and the transformation temperature are as follows:

First embodiment:

Area ratio: 20–90%.

Transformation temperature: 900° C. or higher.

Second embodiment:

Area ratio: 20–70%.

Transformation temperature: 950° C. or higher.

Third to fifth embodiments:

Area ratio: 20–80%.

Transformation temperature: 1000° C. or higher.

Such heat-resistant, ferritic cast steel of the present invention is particularly suitable for exhaust equipment members for automobiles. As the exhaust equipment members for automobiles, FIG. 1 shows an integral exhaust manifold mounted to a straight-type, four-cylinder engine equipped with a turbo charger. The exhaust manifold 1 is mounted to a turbine housing 2 of the turbo charger, which is connected to a catalyst converter chamber 4 for cleaning an exhaust gas via an exhaust outlet pipe 3. The converter chamber 4 is further connected to a main catalyzer 5. An outlet of the main catalyzer 5 is communicated with a muffler (not shown) in D. The turbine housing 2 is communicated with an intake manifold (not shown) in B, and an air is introduced thereinto as shown by C. Incidentally, the exhaust gas is introduced into the exhaust manifold 1 as shown by A.

Such exhaust manifold 1 and turbine housing 2 are desirably as thin as possible to have a small heat capacity. The thicknesses of the exhaust manifold 1 and the turbine housing 2 are, for instance, 2.5–3.4 mm and 2.7–4.1 mm, respectively.

Such thin exhaust manifold 1 and turbine housing 2 made of the heat-resistant, ferritic cast steel show excellent durability without suffering from cracks under heating-cooling cycles.

The present invention will be explained in detail by way of the following Examples.

EXAMPLES 1–9, COMPARATIVE EXAMPLES 1–5

With respect to heat-resistant, ferritic cast steels having compositions shown in Table 1, Y-block test pieces (No. B according to JIS) were prepared by casting. Incidentally, the casting was conducted by melting the steel in the atmosphere in a 100-kg high-frequency furnace, removing the resulting melt from the furnace at a temperature of 1550° C. or higher and pouring it into a mold at about 1550° C.

TABLE 1

| | Additive Component (Weight %) | | | | | | | | $\alpha'/(\alpha+\alpha')$ | Transformation Temperature |
|---|---|---|---|---|---|---|---|---|---|---|
| | C | Si | Mn | Cr | W | Nb | Ni | N | (%) | (°C.) |
| Example No. | | | | | | | | | | |
| 1 | 0.12 | 0.80 | 0.55 | 16.2 | 1.15 | 0.20 | 0.20 | 0.03 | 65 | 920 |
| 2 | 0.16 | 0.93 | 0.48 | 18.4 | 1.95 | 0.34 | 0.75 | 0.04 | 50 | 970 |
| 3 | 0.21 | 1.14 | 0.62 | 20.1 | 3.52 | 0.15 | 0.94 | 0.02 | 35 | 1020 |
| 4 | 0.25 | 1.52 | 0.78 | 22.4 | 4.05 | 0.08 | 1.45 | 0.04 | 30 | 1050 |
| 5 | 0.28 | 1.03 | 0.57 | 24.8 | 4.78 | 0.12 | 1.82 | 0.04 | 28 | 1090 |
| 6 | 0.18 | 0.88 | 0.60 | 18.4 | 1.25 | 0.45 | 1.25 | 0.03 | 65 | 920 |
| 7 | 0.20 | 1.08 | 0.44 | 18.6 | 2.45 | 0.25 | 0.65 | 0.03 | 50 | 990 |
| 8 | 0.23 | 0.95 | 0.61 | 18.1 | 2.93 | 0.09 | 0.94 | 0.03 | 75 | 930 |
| 9 | 0.24 | 0.82 | 0.53 | 17.8 | 2.02 | 0.15 | 0.52 | 0.04 | 85 | 930 |
| Comparative Example No. | | | | | | | | | | |
| 1 | 3.33 | 4.04 | 0.35 | — | — | — | 0.62* | — | — | 800–850 |
| 2 | 2.01 | 4.82 | 0.45 | 1.91 | — | — | 35.3 | — | — | — |
| 3 | 0.28 | 1.05 | 0.44 | 17.9 | — | — | — | — | 93 | 910 |
| 4 | 0.21 | 1.24 | 0.50 | 18.8 | — | — | 9.1 | — | — | — |
| 5 | 0.12 | 1.05 | 0.48 | 18.1 | — | 1.12 | — | — | 0 | >1100 |

Note
*Mo

With respect to the heat-resistant, ferritic cast steels of Examples 1–9, their fluidity was good in the process of casting, resulting in no casting defects. Next, test pieces (Y-blocks) of Examples 1–9 were subjected to a heat treatment comprising heating them at 800° C. for 2 hours in a furnace and cooling them in the air. On the other hand, the test pieces of Comparative Examples 1–5 were used in an as-cast state for the tests.

Incidentally, the test pieces of Comparative Examples 1–5 are those used for heat-resistant parts such as turbo charger housings, exhaust manifolds, etc. for automobiles. The test piece of Comparative Example 1 is high-Si spheroidal graphite cast iron, the test piece of Comparative Example 2 is NI-RESIST spheroidal graphite cast iron, the test piece of Comparative Example 3 is a CB-30 according to the ACI (Alloy Casting Institute) standards, the test piece of Comparative Example 4 is one of heat-resistant austenite cast steels (SCH 12, according to JIS), and the test piece of Comparative Example 5 is a heat-resistant, ferritic cast steel (NSHR-F2, trademark of Hitachi Metals, Ltd.) used for exhaust manifolds for high-performance engines.

As shown in Table 1, the test pieces of Examples 1–9 show transformation temperatures of 900° C. or higher, higher than those of Comparative Examples 1 and 3.

Next, with respect to each cast test piece, the following evaluation tests were conducted.

(1) Tensile test at a room temperature

Conducted on a rod test piece having a gauge distance of 50 mm and a gauge diameter of 14 mm (No. 4 test piece according to JIS).

(2) Tensile test at a high temperature

Conducted on a flanged test piece having a gauge distance of 50 mm and a gauge diameter of 10 mm at a temperature of 900° C.

(3) Thermal fatigue test

Using a rod test piece having a gauge distance of 20 mm and a gauge diameter of 10 mm, a heating-cooling cycle was repeated to cause thermal fatigue failure in a state where expansion and shrinkage due to heating and cooling were completely restrained mechanically, under the following conditions:

Lowest temperature: 100° C.
Highest temperature: 900° C.
Each 1 cycle: 12 minutes.

Incidentally, an electric-hydraulic servo-type thermal fatigue test machine was used for the test.

(4) Oxidation test

A rod test piece having a diameter of 10 mm and a length of 20 mm was kept in the air at 900° C. for 200 hours, and its oxide scale was removed by a shot blasting treatment to measure a weight variation per a unit surface area. By calculating oxidation weight loss ($mg/cm^2$) after the oxidation test, the oxidation resistance was evaluated.

The results of the tensile test at a room temperature are shown in Table 2, and the results of the tensile test at a high temperature, the thermal fatigue test and the oxidation test are shown in Table 3.

TABLE 2

| | at Room Temperature | | | |
|---|---|---|---|---|
| | 0.2% Offset Yield Strength (MPa) | Tensile Strength (MPa) | Elongation (%) | Hardness ($H_B$) |
| Example No. | | | | |
| 1 | 380 | 480 | 6 | 179 |
| 2 | 450 | 650 | 10 | 223 |
| 3 | 500 | 770 | 12 | 235 |
| 4 | 440 | 620 | 12 | 201 |
| 5 | 500 | 605 | 8 | 207 |
| 6 | 480 | 590 | 5 | 207 |
| 7 | 460 | 530 | 10 | 217 |
| 8 | 530 | 600 | 8 | 192 |
| 9 | 570 | 610 | 5 | 201 |
| Comparative Example No. | | | | |
| 1 | 510 | 640 | 11 | 215 |
| 2 | 245 | 510 | 19 | 139 |
| 3 | 540 | 760 | 4 | 240 |
| 4 | 250 | 560 | 20 | 170 |
| 5 | 300 | 370 | 1 | 149 |

TABLE 3

| | at 900° C. | | | | |
|---|---|---|---|---|---|
| | 0.2% Offset Yield Strength (MPa) | Tensile Strength (MPa) | Elongation (%) | Thermal Fatigue Life (Cycle) | Weight Loss by Oxidation ($mg/cm^2$) |
| Example No. | | | | | |
| 1 | 20 | 36 | 44 | 82 | 2 |
| 2 | 23 | 40 | 50 | 276 | 1 |
| 3 | 25 | 44 | 48 | 514 | 1 |
| 4 | 27 | 48 | 52 | 157 | 2 |
| 5 | 20 | 40 | 51 | 553 | 1 |
| 6 | 24 | 50 | 54 | 360 | 1 |
| 7 | 23 | 46 | 48 | 331 | 1 |
| 8 | 26 | 52 | 38 | 531 | 1 |
| 9 | 28 | 58 | 40 | 480 | 1 |
| Comparative Example No. | | | | | |
| 1 | 20 | 40 | 33 | 9 | 200 |
| 2 | 40 | 90 | 44 | 23 | 20 |
| 3 | 25 | 42 | 58 | 18 | 1 |
| 4 | 65 | 128 | 31 | 35 | 2 |
| 5 | 15 | 28 | 93 | 185 | 2 |

As is clear from Tables 2 and 3, the test pieces of Examples 1–9 are extremely superior to those of Comparative Examples 1–5 with respect to a high-temperature strength, an oxidation resistance and a thermal fatigue life. This is due to the fact that by containing proper amounts of W, Nb, Ni and N, the ferrite matrix was strengthened, and the transformation temperature was elevated to 900° C. or higher without deteriorating the ductility at a room temperature.

Also, as shown in Table 2, the test pieces of Examples 1–9 show relatively low hardness ($H_B$) of 179–235. This means that they are excellent in machinability.

Figure 2:
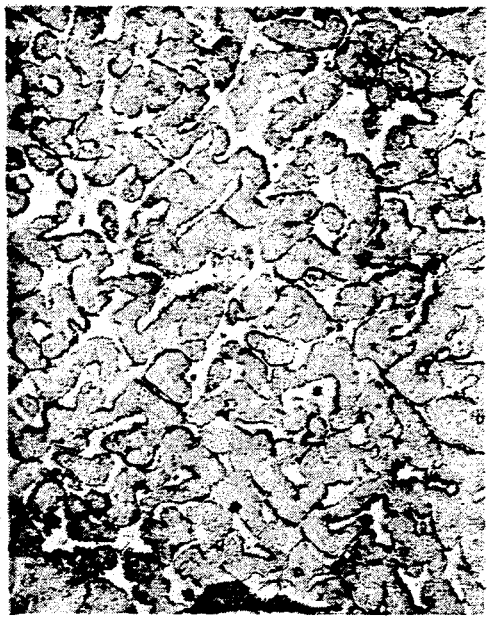
FIG. 2 is a photomicrograph (×100) showing the metal structure of the heat-resistant, ferritic cast steel of Example 8.
Figure 3:
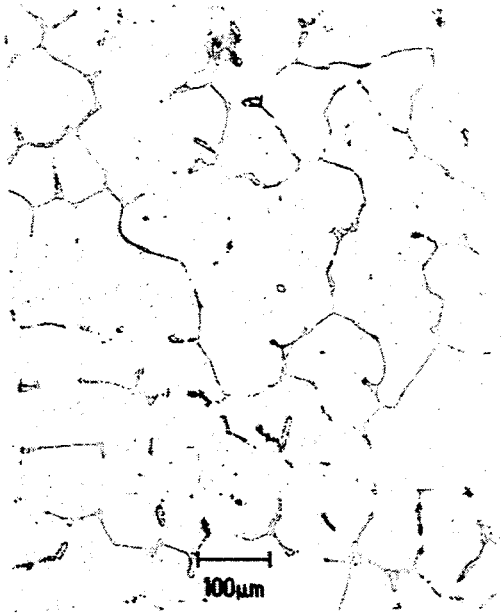
FIG. 3 is a photomicrograph (×100) showing the metal structure of the heat-resistant, ferritic cast steel of Comparative Example 5.

Incidentally, with respect to the heat-resistant cast steels of Example 8 and Comparative Example 5, their photomicrographs (×100) are shown in FIGS. 2 and 3, respectively.

EXAMPLES 10–19

With respect to the heat-resistant, ferritic cast steels having compositions shown in Table 4, Y-block test pieces (No. B according to JIS) were prepared in the same manner as in Example 1.

TABLE 4

| Example No. | Additive Component (Weight %) | | | | | | | | | $\alpha'/(\alpha+\alpha')$ (%) | Transformation Temperature (°C.) |
|---|---|---|---|---|---|---|---|---|---|---|---|
| | C | Si | Mn | Cr | W | Nb | V | Ni | B | | |
| 10 | 0.11 | 0.88 | 0.48 | 15.9 | 1.48 | 0.02 | 0.20 | 0.07 | 0.002 | 60 | 970 |
| 11 | 0.15 | 1.00 | 0.65 | 18.9 | 2.05 | 0.42 | 0.08 | 0.50 | 0.008 | 30 | 1045 |
| 12 | 0.22 | 1.52 | 0.82 | 21.5 | 1.52 | 0.10 | 0.42 | 1.50 | 0.005 | 28 | 1080 |
| 13 | 0.28 | 1.15 | 0.52 | 23.6 | 4.20 | 0.08 | 0.15 | 0.59 | 0.003 | 22 | 1100 |
| 14 | 0.12 | 0.78 | 0.71 | 18.4 | 3.05 | 0.22 | 0.05 | 0.12 | 0.006 | 30 | 1030 |
| 15 | 0.18 | 0.92 | 0.45 | 20.4 | 1.94 | 0.05 | 0.18 | 1.02 | 0.003 | 25 | 1080 |
| 16 | 0.08 | 1.08 | 0.52 | 18.2 | 4.99 | 0.07 | 0.07 | 1.89 | 0.004 | 30 | 1040 |
| 17 | 0.12 | 1.11 | 0.49 | 18.6 | 2.25 | 0.35 | 0.25 | 0.15 | 0.006 | 35 | 1010 |
| 18 | 0.15 | 0.89 | 0.54 | 17.8 | 1.88 | 0.08 | 0.16 | 0.11 | 0.009 | 50 | 960 |
| 19 | 0.11 | 1.32 | 0.91 | 18.7 | 2.12 | 0.13 | 0.10 | 0.09 | 0.004 | 40 | 1020 |

With respect to the heat-resistant, ferritic cast steels of Examples 10–19, their fluidity was good in the process of casting, resulting in no casting defects. Next, test pieces (Y-blocks) of Examples 10–19 were subjected to a heat treatment comprising heating them at 800° C. for 2 hours in a furnace and cooling them in the air.

As shown in Table 4, the test pieces of Examples 10–19 show transformation temperatures of 950° C. of higher, higher than those of Comparative Examples 1–4.

Next, with respect to each cast test piece, the tensile test at a room temperature, the tensile test at a high temperature, the thermal fatigue test and the oxidation test were conducted under the same conditions as in Examples 1-9.

The results of the tensile test at a room temperature are shown in Table 5, and the results of the tensile test at a high temperature, the thermal fatigue test and the oxidation test are shown in Table 6.

TABLE 5 at Room Temperature

| Example No. | 0.2% Offset Yield Strength (MPa) | Tensile Strength (MPa) | Elongation (%) | Hardness ($H_B$) |
|---|---|---|---|---|
| 10 | 420 | 460 | 5 | 212 |
| 11 | 450 | 530 | 6 | 212 |
| 12 | 360 | 390 | 4 | 183 |
| 13 | 460 | 480 | 4 | 217 |
| 14 | 400 | 430 | 5 | 201 |
| 15 | 450 | 475 | 5 | 207 |
| 16 | 370 | 500 | 4 | 187 |
| 17 | 385 | 490 | 5 | 174 |
| 18 | 430 | 480 | 6 | 182 |
| 19 | 410 | 450 | 6 | 179 |

TABLE 6 at 900° C.

| Example No. | 0.2% Offset Yield Strength (MPa) | Tensile Strength (MPa) | Elongation (%) | Thermal Fatigue Life (Cycle) | Weight Loss by Oxidation ($mg/cm^2$) |
|---|---|---|---|---|---|
| 10 | 20 | 41 | 45 | 210 | 3 |
| 11 | 22 | 46 | 54 | 185 | 2 |
| 12 | 21 | 42 | 47 | 201 | 1 |
| 13 | 25 | 50 | 44 | 251 | 1 |
| 14 | 23 | 46 | 48 | 268 | 2 |
| 15 | 25 | 52 | 60 | 266 | 1 |
| 16 | 22 | 44 | 53 | 189 | 2 |
| 17 | 22 | 47 | 46 | 248 | 1 |
| 18 | 24 | 48 | 57 | 322 | 2 |
| 19 | 23 | 48 | 51 | 250 | 1 |

As is clear from Tables 5 and 6, the test pieces of Examples 10-19 are extremely superior to those of Comparative Examples 1-5 with respect to a high-temperature strength, an oxidation resistance and a thermal fatigue life. This is due to the fact that by containing proper amounts of W, Nb, V, B and Ni, the ferrite matrix was strengthened, and the transformation temperature was elevated to 950° C. or higher without deteriorating the ductility at a room temperature.

Also, as shown in Table 5, the test pieces of Examples 10-19 show relatively low hardness ($H_B$) of 174-217. This means that they are excellent in machinability.

Figure 4:
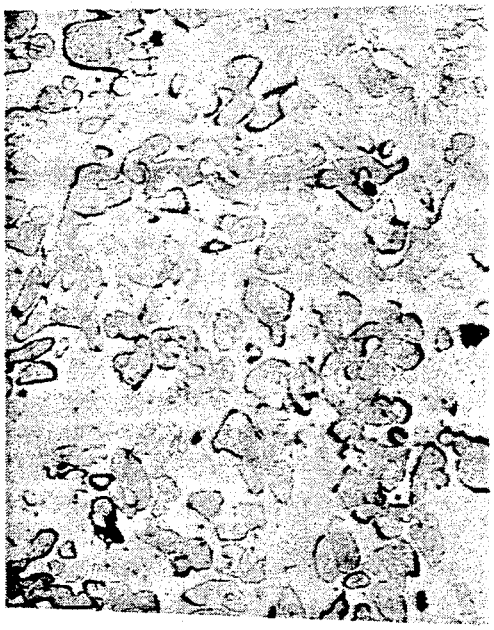
FIG. 4 is a photomicrograph (×100) showing the metal structure of the heat-resistant, ferritic cast steel of Example 18.

Incidentally, with respect to the heat-resistant cast steel of Example 18, its photomicrograph (×100) is shown in FIG. 4.

EXAMPLES 20-34

With respect to the heat-resistant, ferritic cast steels having compositions shown in Table 7, Y-block test pieces (No. B according to JIS) were prepared in the same manner as in Example 1.

TABLE 7

| Example No. | Additive Component (Weight %) C | Si | Mn | Cr | W | Nb | V | Ni | B | REM | $\alpha'/(\alpha+\alpha')$ (%) | Transformation Temperature (°C.) |
|---|---|---|---|---|---|---|---|---|---|---|---|---|
| 20 | 0.16 | 0.82 | 0.44 | 18.6 | 1.52 | 0.05 | — | — | — | — | 55 | 1010 |
| 21 | 0.22 | 1.52 | 0.53 | 20.5 | 3.08 | — | 0.35 | — | — | — | 62 | 1060 |
| 22 | 0.33 | 1.02 | 0.66 | 21.8 | 2.52 | 0.4 | 0.09 | — | — | — | 58 | 1070 |
| 23 | 0.42 | 1.09 | 0.69 | 18.3 | 3.85 | 0.15 | 0.15 | — | — | — | 72 | 1050 |
| 24 | 0.30 | 1.82 | 0.95 | 21.5 | 2.04 | 0.25 | 0.03 | — | — | — | 48 | >1100 |
| 25 | 0.22 | 1.05 | 0.42 | 18.6 | 1.06 | 0.10 | 0.05 | — | 0.005 | 0.01 | 78 | 1040 |
| 26 | 0.31 | 0.92 | 0.61 | 20.3 | 3.80 | 0.35 | 0.10 | — | 0.04 | 0.005 | 52 | >1100 |
| 27 | 0.45 | 0.80 | 0.49 | 21.8 | 2.25 | 0.05 | 0.38 | — | 0.005 | 0.008 | 68 | 1020 |
| 28 | 0.29 | 0.95 | 0.58 | 20.3 | 2.09 | 0.05 | 0.05 | — | 0.01 | 0.009 | 70 | >1100 |
| 29 | 0.15 | 0.89 | 0.43 | 20.9 | 2.49 | 0.25 | 0.20 | — | 0.008 | 0.04 | 38 | >1100 |
| 30 | 0.17 | 1.08 | 0.62 | 17.9 | 1.44 | 0.05 | 0.30 | 0.42 | 0.005 | 0.03 | 45 | 1050 |
| 31 | 0.30 | 0.98 | 0.48 | 20.5 | 2.95 | 0.42 | 0.05 | 1.05 | 0.02 | 0.005 | 60 | 1040 |
| 32 | 0.43 | 1.80 | 0.81 | 21.8 | 3.72 | 0.15 | 0.18 | 1.86 | 0.005 | 0.003 | 68 | 1020 |
| 33 | 0.25 | 0.94 | 0.52 | 18.9 | 2.05 | 0.08 | 0.02 | 0.75 | 0.04 | 0.005 | 65 | 1060 |
| 34 | 0.31 | 1.04 | 0.49 | 18.5 | 2.11 | 0.06 | 0.03 | 0.57 | 0.004 | 0.01 | 56 | 1080 |

With respect to the heat-resistant, ferritic cast steels of Examples 20-34, their fluidity was good in the process of casting, resulting in no casting defects. Next, test pieces (Y-blocks) of Examples 20-34 were subjected to a heat treatment comprising heating them at 800° C. for 2 hours in a furnace and cooling them in the air.

As shown in Table 7, the test pieces of Examples 20-34 show transformation temperatures of 1000° C. or higher, higher than those of Comparative Examples 1 and 3.

Next, with respect to each cast test piece, the same evaluation tests as in Example 1 were conducted. Incidentally, the tensile test at a high temperature and the oxidation test were conducted at 900° C. and 1000° C., respectively.

Further, the conditions of the thermal fatigue test are as follows:

Lowest temperature: 150° C.

Highest temperature: 900° C. and 1000° C.

Each 1 cycle: 12 minutes.

The results of the tensile test at a room temperature are shown in Table 8, and the results of the tensile test at a high temperature, the thermal fatigue test and the oxidation test are shown in Table 9 (at 900° C.) and Table 10 (1000° C).

TABLE 8 at Room Temperature

| Example No. | 0.2% Offset Yield Strength (MPa) | Tensile Strength (MPa) | Elongation (%) | Hardness ($H_B$) |
|---|---|---|---|---|
| 20 | 360 | 460 | 5 | 170 |
| 21 | 340 | 475 | 6 | 192 |
| 22 | 380 | 500 | 8 | 207 |
| 23 | 425 | 570 | 4 | 212 |
| 24 | 350 | 490 | 4 | 212 |
| 25 | 345 | 450 | 4 | 207 |
| 26 | 335 | 425 | 6 | 202 |
| 27 | 405 | 480 | 8 | 197 |

TABLE 8-continued

| Example No. | 0.2% Offset Yield Strength (MPa) | Tensile Strength (MPa) | Elongation (%) | Hardness ($H_B$) |
|---|---|---|---|---|
| | at Room Temperature | | | |
| 28 | 410 | 510 | 4 | 207 |
| 29 | 395 | 495 | 6 | 193 |
| 30 | 470 | 580 | 4 | 197 |
| 31 | 520 | 600 | 6 | 201 |
| 32 | 550 | 650 | 4 | 223 |
| 33 | 505 | 595 | 6 | 212 |
| 34 | 535 | 605 | 4 | 217 |

TABLE 9

| Example No. | 0.2% Offset Yield Strength (MPa) | Tensile Strength (MPa) | Elongation (%) | Thermal Fatigue Life (Cycle) | Weight Loss by Oxidation (mg/cm$^2$) |
|---|---|---|---|---|---|
| | at 900° C. | | | | |
| 20 | 21 | 37 | 50 | 180 | 2 |
| 21 | 24 | 39 | 45 | 215 | 1 |
| 22 | 25 | 41 | 38 | 232 | 1 |
| 23 | 28 | 43 | 42 | 368 | 2 |
| 24 | 27 | 40 | 55 | 342 | 1 |
| 25 | 29 | 45 | 52 | 445 | 2 |
| 26 | 23 | 38 | 62 | 382 | 1 |
| 27 | 30 | 48 | 33 | 489 | 1 |
| 28 | 28 | 44 | 54 | 325 | 1 |
| 29 | 22 | 42 | 58 | 288 | 2 |
| 30 | 21 | 44 | 65 | 468 | 1 |
| 31 | 25 | 46 | 50 | 325 | 2 |
| 32 | 27 | 48 | 35 | 225 | 2 |
| 33 | 28 | 52 | 45 | 252 | 1 |
| 34 | 29 | 50 | 60 | 365 | 1 |

TABLE 10

| Example No. | 0.2% Offset Yield Strength (MPa) | Tensile Strength (MPa) | Elongation (%) | Thermal Fatigue Life (Cycle) | Weight Loss by Oxidation (mg/cm$^2$) |
|---|---|---|---|---|---|
| | at 1000° C. | | | | |
| 20 | 14 | 24 | 80 | 95 | 29 |
| 21 | 16 | 25 | 92 | 180 | 8 |
| 22 | 17 | 28 | 98 | 195 | 13 |
| 23 | 17 | 29 | 100 | 290 | 14 |
| 24 | 15 | 26 | 115 | 242 | 22 |
| 25 | 18 | 30 | 108 | 350 | 33 |
| 26 | 14 | 23 | 84 | 290 | 11 |
| 27 | 19 | 31 | 96 | 365 | 18 |
| 28 | 15 | 24 | 76 | 254 | 15 |
| 29 | 15 | 25 | 88 | 205 | 9 |
| 30 | 14 | 23 | 102 | 305 | 18 |
| 31 | 14 | 24 | 123 | 205 | 34 |
| 32 | 18 | 29 | 135 | 154 | 46 |
| 33 | 17 | 29 | 149 | 175 | 26 |
| 34 | 16 | 26 | 156 | 225 | 21 |

As is clear from Tables 8–10, the test pieces of Examples 20–34 are extremely superior to those of Comparative Examples 1–5 with respect to a high-temperature strength, an oxidation resistance and a thermal fatigue life. This is due to the fact that by containing proper amounts of W, B, REM, etc., the ferrite matrix was strengthened, and the transformation temperature was elevated to 1000° C. or higher without deteriorating the ductility at a room temperature.

Also, as shown in Table 8, the test pieces of Examples 20–34 show relatively low hardness ($H_B$) of 170–223. This means that they are excellent in machinability.

Figure 5:
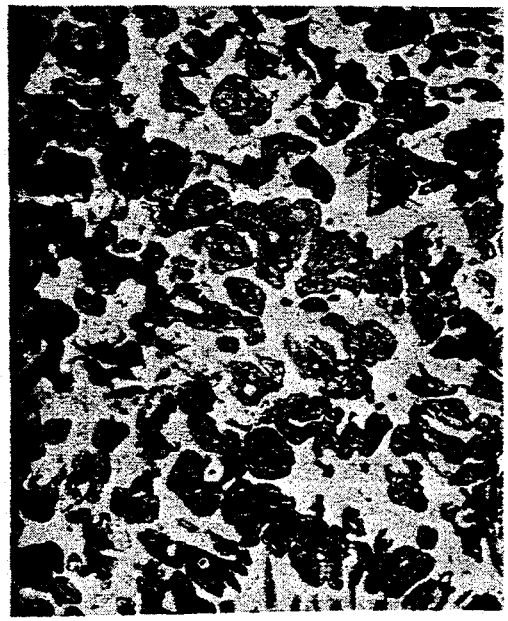
FIG. 5 is a photomicrograph (×100) showing the metal structure of the heat-resistant, ferritic cast steel of Example 31.

Incidentally, with respect to the heat-resistant cast steel of Example 31, its photomicrograph (×100) is shown in FIG. 5.

Next, an exhaust manifold (thickness: 2.5–3.4 mm) and a turbine housing (thickness: 2.7–4.1 mm) were produced by casting the heat-resistant, ferritic cast steel of Examples 5, 15 and 26. All of the resulting heat-resistant cast steel parts were free from casting defects. These cast parts were machined to evaluate their cuttability. As a result, no problem was found in any cast parts.

Next, the exhaust manifold and the turbine housing were mounted to a high-performance, straight-type, four-cylinder, 2000-cc gasoline engine (test machine) to conduct a durability test. The test was conducted by repeating 500 heating-cooling (Go-Stop) cycles each consisting of a continuous full-load operation at 6000 rpm (14 minutes), idling (1 minute), complete stop (14 minutes) and idling (1 minute) in this order. The exhaust gas temperature under a full load was 930° C. at the inlet of the turbo charger housing. Under this condition, the highest surface temperature of the exhaust manifold was about 870° C. in a pipe-gathering portion thereof, and the highest surface temperature of the turbo charger housing was about 890° C. in a waist gate portion thereof. As a result of the evaluation test, no gas leak and thermal cracking were observed. It was thus confirmed that the exhaust manifold and the turbine housing made of the heat-resistant, ferritic cast steel of the present invention had excellent durability and reliability.

On the other hand, an exhaust manifold was produced from high-Si spheroidal graphite cast iron having a composition shown in Table 11, and a turbo charger housing was produced from austenite spheroidal graphite cast iron having a composition shown in Table 11 (NI-RESIST D2, trademark of INCO). These parts are mounted to the same engine as above, and the evaluation test was conducted under the same conditions. As a result, the exhaust manifold made of the high-Si spheroidal graphite cast iron underwent thermal cracking due to oxidation in the vicinity of the pipe-gathering portion after 98 cycles, failing to continue the operation. After that, the exhaust manifold was exchanged to that of Example 5 and the evaluation test was continued. As a result, after 324 cycles, cracking took place in a scroll portion of the turbo charger housing made of the austenite spheroidal graphite cast iron. The cracks were penetrating through the scroll portion. It is thus clear that the exhaust manifold and the turbo charger housing according to the present invention have excellent heat resistance.

TABLE 11

| Type | Chemical Component (Weight %) | | | | | | | | |
|---|---|---|---|---|---|---|---|---|---|
| | C | Si | Mn | P | S | Cr | Ni | Mo | Mg |
| High-Si Spheroidal Graphite Cast Iron | 3.15 | 3.95 | 0.47 | 0.024 | 0.008 | 0.03 | — | 0.55 | 0.048 |
| Austenite Spheroidal Graphite Cast Iron | 2.91 | 2.61 | 0.81 | 0.018 | 0.010 | 2.57 | 21.5 | — | 0.084 |

As described above in detail, by adding W, Nb and/or V and, if necessary, B, REM, Ni, N alone or in combination in proper amounts according to the present invention, the ferrite matrix and the crystal grain boundaries are strengthened, whereby the transformation temperature of the heat-resistant, ferritic cast steel is elevated without deteriorating the ductility at a room temperature. As a result, the heat-resistant, ferritic cast steel of the present invention has an improved high-temperature strength. Thus, with respect to particularly important high-temperature strength, thermal fatigue resistance and oxidation resistance, the heat-resistant, ferritic cast steel of the present invention is superior to the conventional heat-resistant cast steel. In addition, since the heat-resistant, ferritic cast steel of the present invention is excellent in castability and machinability, it can be formed into cast articles at a low cost. Such heat-resistant, ferritic cast steel according to the present invention is particularly suitable for exhaust equipment members for engines, etc. The exhaust equipment members made of such heat-resistant, ferritic cast steel according to the present invention show extremely good durability without suffering from thermal cracking.

What is claimed is:

1. A heat-resistant, ferritic cast steel having a composition consisting essentially, by weight, of:

C: 0.05–0.45%,
Si: 0.4–2.0%,
Mn: 0.3–1.0%,
Cr: 16.0–25.0%,
W: 1.2–3.0%,
Ni: 0–2.0%,
Nb and/or V: 0.01–1.0% (each 0.5% or less), and
Fe and inevitable impurities: balance, said cast steel having, in addition to a usual $\alpha$-phase, a phase (hereinafter referred to as "$\alpha'$-phase") transformed from a $\gamma$-phase and composed of an $\alpha$-phase and carbides, an area ratio ($\alpha'/(\alpha+\alpha')$) being 20–90%, said cast steel being subjected to an annealing treatment at a temperature in the range where the $\alpha'$-phase is not transformed to the $\gamma$-phase.

2. The heat-resistant, ferritic cast steel according to claim 1, wherein a transformation temperature from the $\alpha'$-phase to the $\gamma$-phase is 900° C. or higher.

3. An exhaust equipment member made of a heat-resistant, ferritic cast steel according to claim 1.

4. The exhaust equipment member according to claim 3, wherein said exhaust equipment member is an exhaust manifold.

5. The exhaust equipment member according to claim 3, wherein said exhaust equipment member is a turbine housing.

6. The heat-resistant, ferritic cast steel according to claim 1, further containing 0.1–2.0% by weight of Ni.

7. The heat-resistant, ferritic cast steel according to claim 2, further containing 0.1–2.0% by weight of Ni.

* * * * *